US005570525A

United States Patent [19]

Paglieri et al.

[11] Patent Number: 5,570,525

[45] Date of Patent: Nov. 5, 1996

[54] FLEXIBLE FACE SIGN WITH UNIFORM LUMINOSITY

[75] Inventors: Richard E. Paglieri; Daniel C. Hull, both of Columbus, Ohio

[73] Assignee: Signstrut, Ltd., Columbus, Ohio

[21] Appl. No.: 369,647

[22] Filed: Jan. 6, 1995

[51] Int. Cl.[6] ..... G09F 13/04; F21P 1/02

[52] U.S. Cl. ..... 40/564; 40/574; 40/603; 362/240; 362/246; 362/362; 362/320; 362/812

[58] Field of Search ..... 40/454, 564, 579, 40/603, 604, 574; 362/145, 151, 152, 249, 361, 362, 812, 223, 225, 240, 242, 243, 244, 246, 368, 320, 278, 28, 29

[56] References Cited

U.S. PATENT DOCUMENTS

| | | | |
|---|---|---|---|
| 1,737,238 | 11/1929 | Herrschaft . | |
| 4,240,220 | 12/1980 | Smith | 40/564 |
| 4,267,489 | 5/1981 | Morohashi | 40/367 |
| 4,418,378 | 11/1983 | Johnson | 362/223 X |
| 4,432,044 | 2/1984 | Lautzenheiser | 362/223 |
| 4,512,098 | 4/1985 | Ready et al. | 40/564 |
| 4,952,023 | 8/1990 | Bradshaw et al. | 40/564 X |
| 4,975,807 | 12/1990 | Ohashi | 362/28 X |
| 5,006,966 | 4/1991 | Mikalonis | 362/224 X |
| 5,020,252 | 6/1991 | De Boef | 40/564 X |
| 5,127,177 | 7/1992 | Tanner | 40/603 |
| 5,255,459 | 10/1993 | Verret | 40/603 |
| 5,255,466 | 10/1993 | Synder | 40/603 |
| 5,265,362 | 11/1993 | Yamaguchi | 40/603 |
| 5,282,330 | 2/1994 | Hannula | 40/564 X |
| 5,325,272 | 6/1994 | Miller | 362/243 X |
| 5,381,324 | 1/1995 | Hillstrom et al. | 362/362 |
| 5,444,931 | 8/1995 | Hillstrom | 40/564 |

*Primary Examiner*—Peter M. Cuomo
*Assistant Examiner*—James O. Hansen
*Attorney, Agent, or Firm*—Colucci & Umans

[57] ABSTRACT

A flexible sign face has uniform luminosity. The sign includes an elongated enclosure having a rear wall and a flexible face translucent front wall, spaced from the rear wall. A plurality of point sources of light are spaced along the rear wall between the front and rear walls. A reflector is provided between each pair of adjacent point sources for reflecting light received from each adjacent point source, toward the flexible face. A diffusion panel is in front of each point source, and between each point source and the front wall. The diffusion panel has perforations in a pattern which increase in density from a center of the panel outwardly toward edges of the panel. The panel also includes a metal corrugated portion carrying the perforations and a translucent acrylic portion attached to the corrugated portion.

11 Claims, 3 Drawing Sheets

FLEXIBLE FACE SIGN WITH UNIFORM LUMINOSITY

FIELD AND BACKGROUND OF THE INVENTION

The present invention relates in general to flexible face signs, and in particular to a new and useful flexible face sign having a uniformly illuminated display surface.

Flexible face signs have been used for many years in outside environments where large illuminated back-lit displays are necessary such as in gas stations, strip malls, convenience stores and the like. Two major problems in constructing and utilizing signs of this design are firstly, how to maintain the flexible face in a taut semi-rigid condition for a relatively long service life while at the same time permitting the sign face to be replaced, and secondly, how to illuminate the flexible face from the rear so that the uniform luminosity is achieved.

Various structures are known for solving the first problem. Among them is U.S. Pat. No. 5,255,466 assigned to the owner of the present application, which discloses a unique anchoring system for the edges of the flexible face.

Various attempts also exist in the prior art for solving the second problem. This involves two basic approaches. The first is using internal reflectors to distribute the light from the light source and the second is by placing an element in front of the light source to spread the luminosity. Both approaches seek to reduce "hot spots" which appear as areas of high luminosity in the immediate vicinity of the light source and which further has the geometry of the light source. For example, due to the elongated nature of most flexible face signs, it has been known to utilize florescent tubes in various arrays within the sign enclosure. This produces elongated hot spots in front of each florescent tube. Point sources of light have also been utilized but these produce circular hot spots if no special measures are taken to distribute the light.

U.S. Pat. No. 1,737,238 uses curved side reflectors which operate in conjunction with v-shaped reflectors to direct light forwardly to the back of an illuminated panel.

The use of a curved reflector behind a fluorescent tube is disclosed in U.S. Pat. No. 3,546,438. The light is directed into the edge of a light guide and thus used for a different purpose then the even illumination of a broad sign surface.

An even more complex mechanism for evenly distributing light on a back lit display which also includes a screen or light diffuser immediately in front of the light, is disclosed in U.S. Pat. No. 3,957,351. A screen is used in front of a light source which has a back reflector for directing the light forwardly.

The use of a multi-layered interference mirror for spreading out light in a lighting device is shown in U.S. Pat. No. 4,161,015.

The use of fluorescent pigment across a back lit display sign is disclosed in U.S. Pat. No. 4,424,449, as an alternate technique for evening out the illumination of a large illuminated sign.

An earlier use for a light reflecting film used to even out light distribution is found in U.S. Pat. No. 4,729,068. This patent shows the use of reflecting areas having a specific density distribution for varying the amount of light going through the otherwise transparent substrate.

A patent which is relevant to the use of side mirrors at an angle to direct light forwardly is U.S. Pat. No. 4,933,814.

U.S. Pat. Nos. 4,787,708 and 4,883,641, use a prismatic reflecting arrangement for distributing light across a surface. U.S. Pat. Nos. 4,912,605 and 5,186,530 use light guides for conveying light from a point source along a light guide and thereafter laterally out of the light guide to illuminate a light surface.

U.S. Pat. No. 4,937,716 discloses a light escapement port with varying transmissivity for producing a constant illumination across the port. A longitudinal specular light reflector which is partly transmissive and made of one or more dielectric interfaces is also used.

A need remains for a well-engineered and robust construction which produces even luminosity across the broad flexible face of a flexible face sign, and which in addition, facilitates replacement of light sources in the sign and is capable of weathering an outdoor environment for long periods of time with minimum maintenance.

SUMMARY OF THE INVENTION

Accordingly an object of the present invention is to provide a flexible face sign with uniform luminosity which has conveniently located light sources and strong replaceable yet weather resistant components.

A further object of the invention thus is to provide a flexible faces with uniform luminosity comprising: means defining an elongated enclosure having a rear wall and a flexible face translucent front wall, spaced from the rear wall; a plurality of point sources of light spaced along the enclosure and positioned between the front and rear walls; a reflector between each pair of adjacent point sources for reflecting light received laterally from each adjacent point source, outwardly toward a rear surface of the front wall for illuminating a portion of the front wall which is between adjacent point sources of light; and a diffusion panel in front of each point source, and between each point source and the front wall, each diffusion panel having a pattern of perforations which increase in density from a center of the panel, nearest the point source, outwardly toward edges of the panel spaced away from the point source for selectively transmitting light from the point sources to the front wall by a smaller amount immediately adjacent each point source and by a greater amount at locations spaced increasingly from each point source.

A further object of the present invention is to provide a flexible faces with uniform luminosity which is simple in use, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention are illustrated.

DESCRIPTION OF THE PREFERRED EMBODIMENTS

Figures 1, 2, 3:
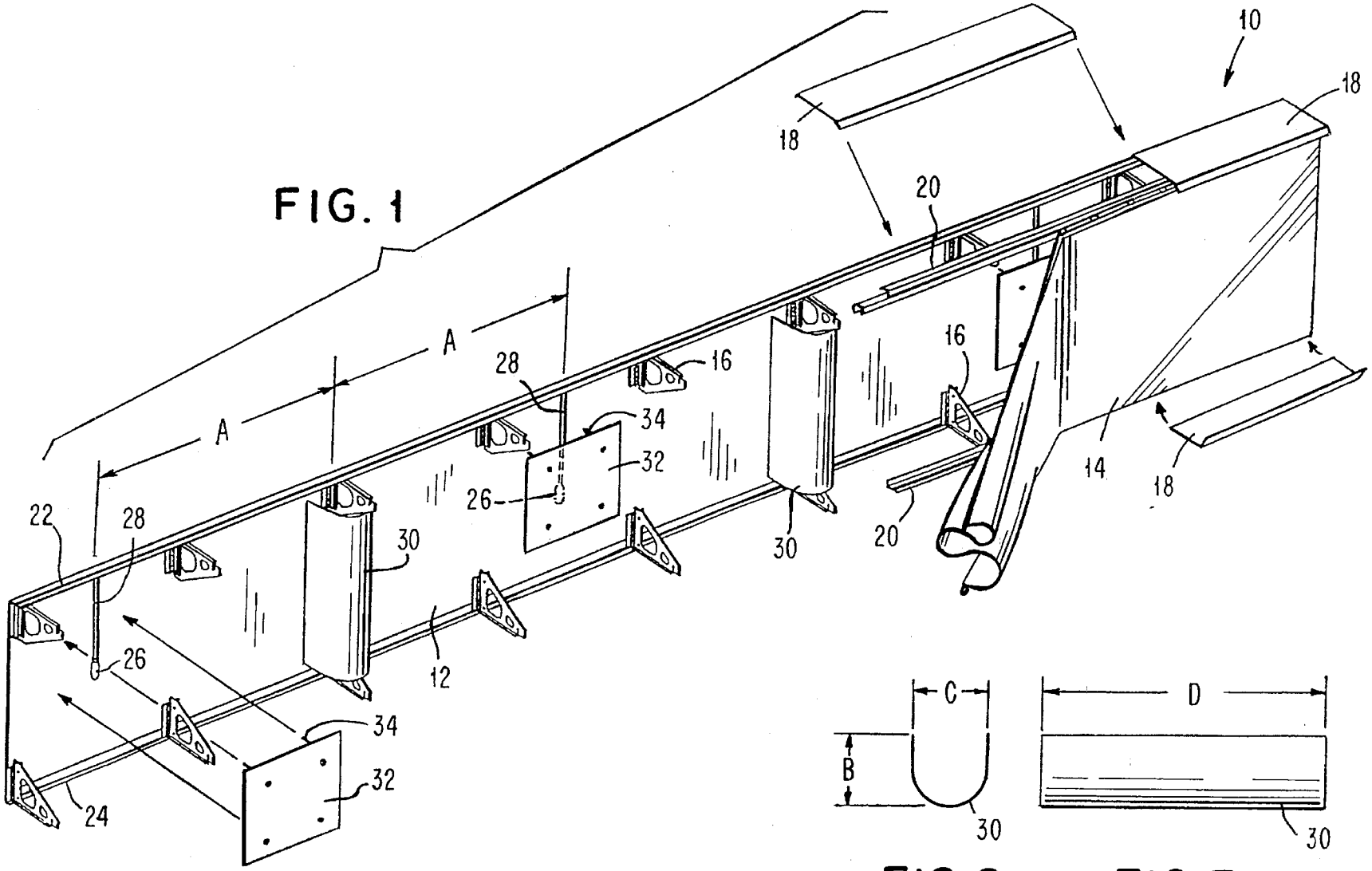
FIG. 1 is an exploded perspective view of the flexible faces of the present invention.
FIG. 2 is an end view of one of the reflectors.
FIG. 3 is a side elevational view of the reflector.

Referring to the drawings, the invention embodied in FIG. 1 comprises a flexible face sign general designated 10 having an enclosure defined between an aluminum back wall 12, a flexible face translucent front wall 14 spaced in front of the rear wall 12, a frame structure 16 attached to the rear wall for supporting upper and lower enclosing panels 18, and for also supporting an edge-tensioning system 20 for engaging and tensioning upper and lower edges of the flexible face 14. Frame and edge structures 16 and 20 are of the type disclosed for example in U.S. Pat. No. 5,127,177. Another example of the edge-tensioning structure 20 can be found in U.S. Pat. No. 5,255,466.

Rear wall 12 is made of lengths of sheet aluminum or other weather resistant metal and may advantageously include forwardly bent upper and lower flanges 22, 24. At spaced locations along the rear wall 12, point sources of light 26 are suspended. These are advantageously in the form of metal halide bulbs and are attached by a conduit which contains appropriate conductors 28, to the top flange 22. In the embodiment shown, bulbs 26 are spaced by increments of approximately 6 feet. A polished aluminum reflector 30 is positioned half-way between each pair of adjacent point sources 26. Dimension A in FIG. 1 is thus equal to about 3 feet and represents the spacing between a point source and its pair of adjacent reflectors, or conversely a reflector and its pair of adjacent point sources.

As shown in FIG. 2, each reflector 30 is curved in a horizontal plane. The curvature may be cylindrical or parabolic or other appropriate shape so that light received laterally from the adjacent point source, is reflected generally toward the rear surface of translucent front wall 14, to illuminate the areas of the front wall which are between and furthest from point source 26. Typical dimensions B, C, and D for reflector 30 are respectively 8, 10 and 27 inches.

Another critical feature of the invention is the presence of diffusion panels 32 attached to and spaced forwardly above rear wall 12 by spacers 34, and above each point source of light 26. Each panel 32 is thus positioned between a point source and the front wall 14. Panels 32 are approximately square, and in the embodiment shown are about 19" long and 23" high.

As will be explained in the following, the function of each diffusion plate 32 is to spread the light of the point sources of light 26, so that they evenly illuminate the back surface of the flexible front wall 14. Additional even light distribution is achieved by reflected light within the enclose, that is reflected from rear wall 12, from inner surfaces of panels 18 and from the rear surface of each diffusion panel 32.

Figure 4:
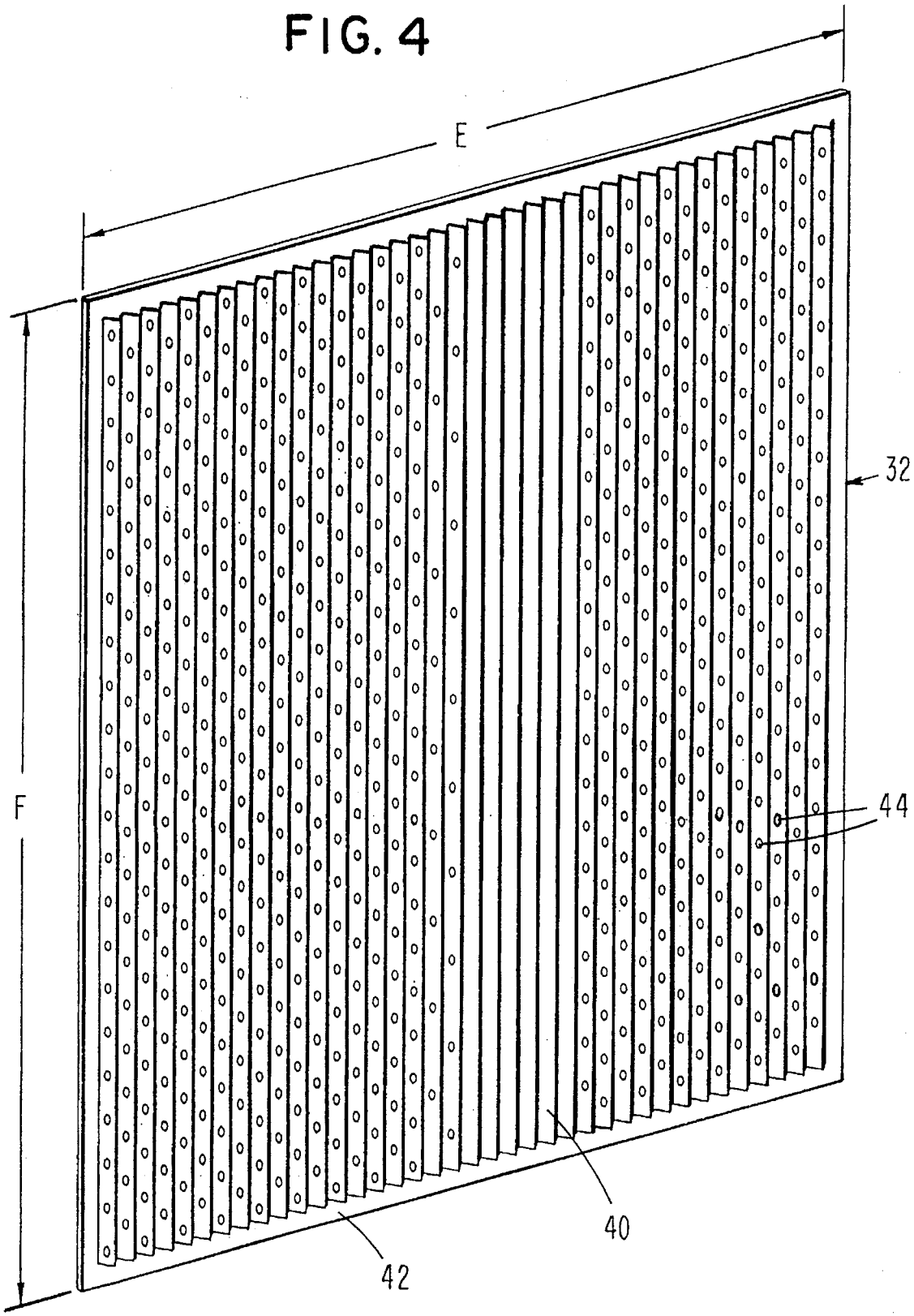
FIG. 4 is a rear perspective view of one of the diffusion panels.

FIG. 4 illustrates the rear surface of a diffusion panel 32, that is the surface that would face the light being emitted from one of the point sources 26. Although the typical dimensions E and F may be 19" and 23", respectively, the different dimensions such as 24" by 21" respectively would also function equally well.

Panel 32 includes a rear polished metal, preferably aluminum corrugated portion 40 which is attached, for example, by heat resistant adhesive, to a translucent, or frosted acrylic front portion 42. This helps further soften and distribute the luminosity from the point source of light and is used in conjunction with a pattern of perforations which are advantageously circular and shown for example, at 44, and which have a density distribution which increases from a lowest density of perforations near the center of the panel and thus nearest the point source of light, to a step-wise or continuously decreasing density, outwardly along the panel toward the edges of the panel.

The substantially V-shaped corrugations in the inner portion 40 and the fact that the surfaces, both inside and out, are reflective, contributes to further scattering and distribution of light from the point source and throughout the sign enclosure. Panel portion 40 is a corrugated sheet metal as shown in FIG. 5.

Figure 5:
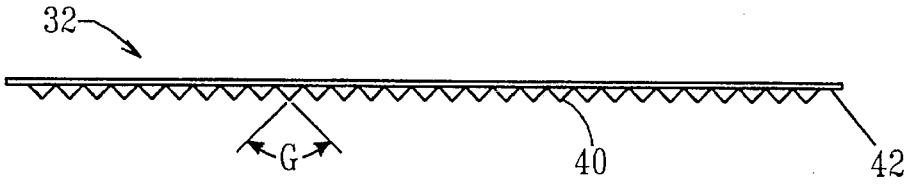
FIG. 5 is a top end view of the diffusion panel.

FIG. 5 which is a top end view of panel 32 shows the typically 90° angle G for the corrugations. In FIG. 5, the upper portion of the figure represents the front of panel 32 and the lower portion of the figure represents the back of the panel; which faces the point source of light.

Figure 6:
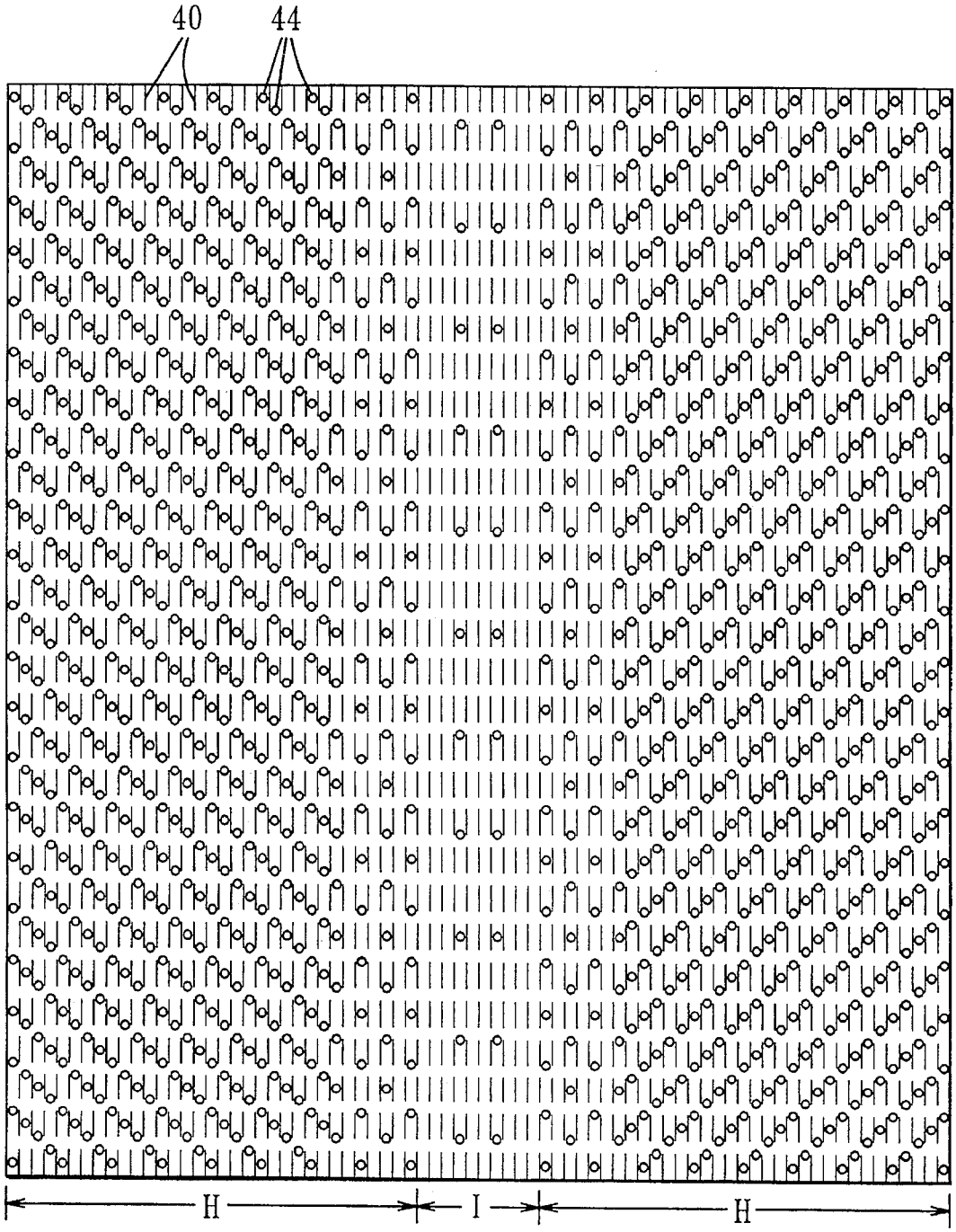
FIG. 6 is a real elevational view of the diffusion panel.

FIG. 6 better illustrates the distribution of perforations 44. For example in a central region I of panel portion 40, the perforations may be spaced by about 2"–4" vertically and on every other corrugations. The spacing gradually changes into edge regions H, H, where vertical spacing is approximately 1" with perforations appearing on every corrugations. The corrugations themselves are typically ¼" across.

The perforations are typically circular and typically 3/16th" in diameter.

While a specific embodiment of the invention has been shown and described in detail to illustrate the application of the principles of the invention, it will be understood that the invention may be embodied otherwise without departing from such principles.

What is claimed is:

1. A flexible sign face with uniform luminosity comprising:

means defining an elongated enclosure having a rear wall and a flexible face translucent front wall, spaced from the rear wall;

a plurality of point sources of light spaced along the enclosure and positioned between the front and rear walls; and a diffusion panel in front of each point source, and between each point source and the front wall, each diffusion panel having a pattern of perforations which increase in density from a center of the panel, nearest the point sources, outwardly toward edges of the panel spaced away from the point source for selectively transmitting light from the point sources to the front wall by a smaller amount immediately adjacent each point source and by a greater amount at locations spaced increasingly from each point source, each diffusion panel being flat and comprising a corrugated metal panel portion having at least one reflective surface facing the point source, the metal panel portion having an opposite surface facing away from the point source, each diffusion panel also comprising a translucent synthetic panel portion attached to the opposite surface of the metal panel portion, each diffusion panel being substantially centered over a respective point source.

2. A sign according to claim 1, including a reflector between each pair of adjacent point sources for reflecting light received laterally from each adjacent point sources, outwardly toward a rear surface of the front wall for illuminating a portion of the front wall which is between adjacent point sources of light.

3. A sign according to claim 2 wherein each reflector is curved in a horizontal plane to be convex toward the rear surface of the front wall, each reflector being vertically elongated.

4. A sign according to claim 1, wherein the corrugated metal panel portion comprises a corrugated sheet metal panel.

5. A sign according to claim 1 wherein the diffusion panel is rectangular, the enclosure having upper and lower walls, the diffusion panel having side edges spaced from each adjacent reflector and upper and lower edges spaced from each adjacent upper and lower wall.

6. A sign according to claim 5 including a frame structure attached to and extending forwardly from the rear wall at upper and lower edges of the wall, upper and lower edge engaging structures attached to the frame structure and connected to upper and lower edges of the front wall for tensioning the front wall.

7. A sign according to claim 6 wherein the perforations are circular and have a diameter of less than ¼", the corrugated metal panel portion having a central area with perforations which are staggered with respect to each other and spaced apart by a greater amount and perforations on opposite sides of the central area, the perforations on the opposite sides of the also being staggered with respect to each other.

8. A sign according to claim 7 wherein the spacing between the staggered perforations in the central area of the metal panel portion are approximately 2" and spacing between the perforations in the sides of the metal panel portion are approximately 1".

9. A sign according to claim 1 including a frame structure attached to and extending forwardly from the rear wall at upper and lower edges of the wall, upper and lower edge engaging structures attached to the frame structure and connected to upper and lower edges of the front wall for tensioning the front wall.

10. A sign according to claim 1 wherein the perforations are circular and have a diameter of less than ¼", the corrugated metal panel portion having a central area with perforations which are staggered with respect to each other and spaced apart by a greater amount and perforations on opposite sides of the central area, the perforations on the opposite sides of the central area also being staggered with respect to each other.

11. A sign according to claim 10 wherein the spacing between the staggered perforations in the central area of the metal panel portion are approximately 2" and spacing between the perforations on the opposite are approximately 1".

* * * * *